United States Patent [19]

Jones

[11] 3,963,096

[45] June 15, 1976

[54] STEPPING STOOL WITH ELEVATING PLATFORM AND CONTROLS

[76] Inventor: Maude M. Jones, 9 Rosedale Ave., Montclair, N.J. 07042

[22] Filed: June 9, 1975

[21] Appl. No.: 585,073

[52] U.S. Cl. ..... 182/15; 182/129; 182/148

[51] Int. Cl.[2] ..... A47C 9/12; E06C 1/397

[58] Field of Search ..... 182/141, 148, 129, 127, 182/15; 187/25, 24; 254/98, 103

[56] References Cited

UNITED STATES PATENTS

| | | | |
|---|---|---|---|
| 1,927,598 | 9/1933 | Schlichter | 182/141 |
| 1,981,680 | 11/1934 | Tindale | 182/141 |
| 2,514,563 | 7/1950 | Todd | 187/25 |
| 2,861,730 | 11/1958 | Deahl | 182/141 |
| 2,897,910 | 8/1959 | Steely | 182/15 |
| 3,342,287 | 9/1967 | Williams | 182/129 |
| 3,493,225 | 2/1970 | Ceraldi | 182/131 |
| 3,826,336 | 7/1974 | Cramer | 182/15 |

*Primary Examiner*—Reinaldo P. Machado
*Attorney, Agent, or Firm*—Richard L. Miller

[57] ABSTRACT

A stool which includes a platform thereupon, the platform being electrically powered and mechanically driven so to elevate to various different heights so that a person, standing on the platform, can reach high up.

1 Claim, 4 Drawing Figures

STEPPING STOOL WITH ELEVATING PLATFORM AND CONTROLS

This invention relates generally to stools that are adjustable in height.

A principal object of the present invention is to provide a stepping stool that includes an elevating platform so that it can be used for sitting upon at a conventional seating level, or which can be raised so a person standing thereupon can reach a higher level than would be possible on a stool having a stationary seat.

Another object is to provide a stepping stool which includes a small table mounted upon the elevating platform so that a person can with least effort elevate or lower a quantity of heavy objects without effort, so that the device would accordingly would be ideal for use in a library to reach high shelves of book cases to replace large numbers of books, or which would be useful for restocking higher shelves in a store, or for use in a home when hanging up curtains or drapes or when painting a ceiling or the like, the table at such time handily holding useful tools so the person does not have to step down and up again repeatedly.

Other objects are to provide a stepping stool with elevating platform and controls which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
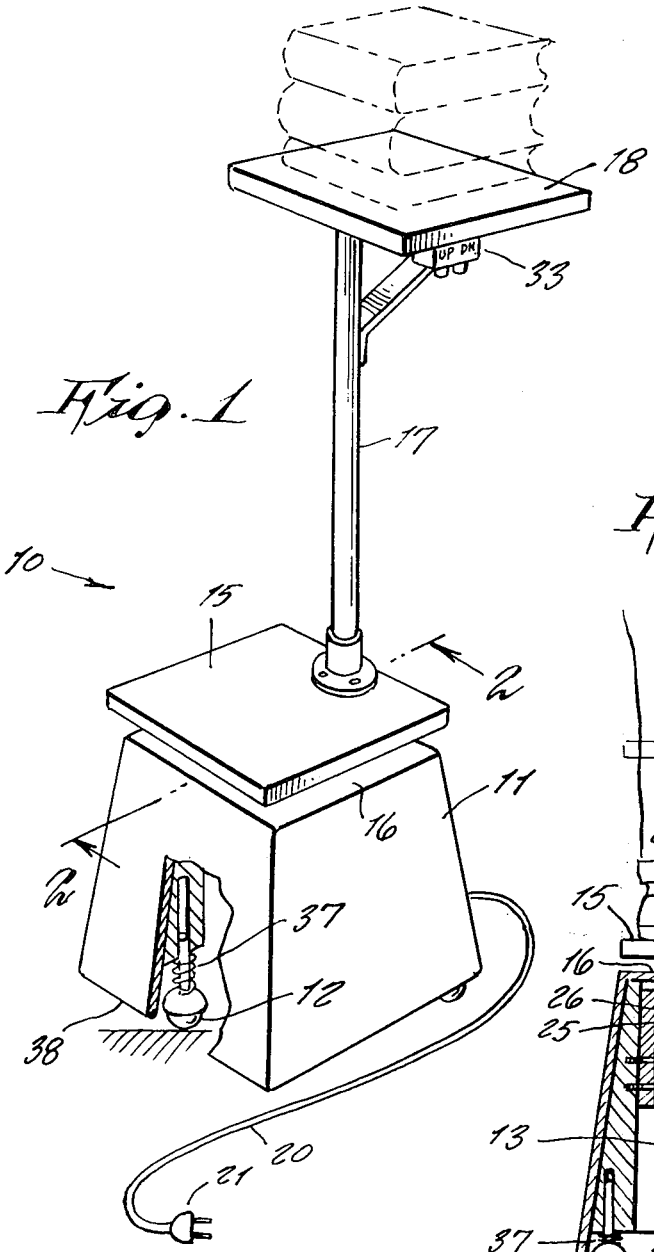
FIG. 1 is a perspective view of the invention.

Referring now to the drawing in details, the reference numeral 10 represents a stepping stool according to the present invention wherein there is a hollow, box-like base 11 made of wood or other suitable material, and which is mounted upon three casters 12 so it can be easily pushed across a floor.

Within the interior 13 of the stool there is a mechanism 14 for vertically moving a platform 15 located above a top wall 16 of the stool, the platform having an upstanding post 17 mounted upon an edge thereof, the post having a table panel 18 mounted upon its upper end for use either as a lectern, or holding books, papers or other objects.

The mechanism 14 includes a two directional electric motor 19 powered through an extension cord 20 fitted with plug 21; the motor driving a gear reducer 22 having ouput shaft 23 fitted with gear 24 engaging a gear 25. A threaded central opening 26 through the gear 25 is engaged on a threaded screw shaft 27 which extends vertically upwardly through an opening 28 of the stool top wall 16 and the upper end of the screw shaft 27 is secured to an underside of the platform.

The gear 25 is retained from vertical travel by means of stationary bracket arms 29 above and below the gear.

A keyway 30 along the screw shaft engages a stationary lug or key 31 mounted on one of the arms 29, and serves to prevent the screw shaft from rotating when the gear 25 is being turned, thus resulting in the screw shaft travelling vertically, and raising or lowering the platform.

Figure 2:
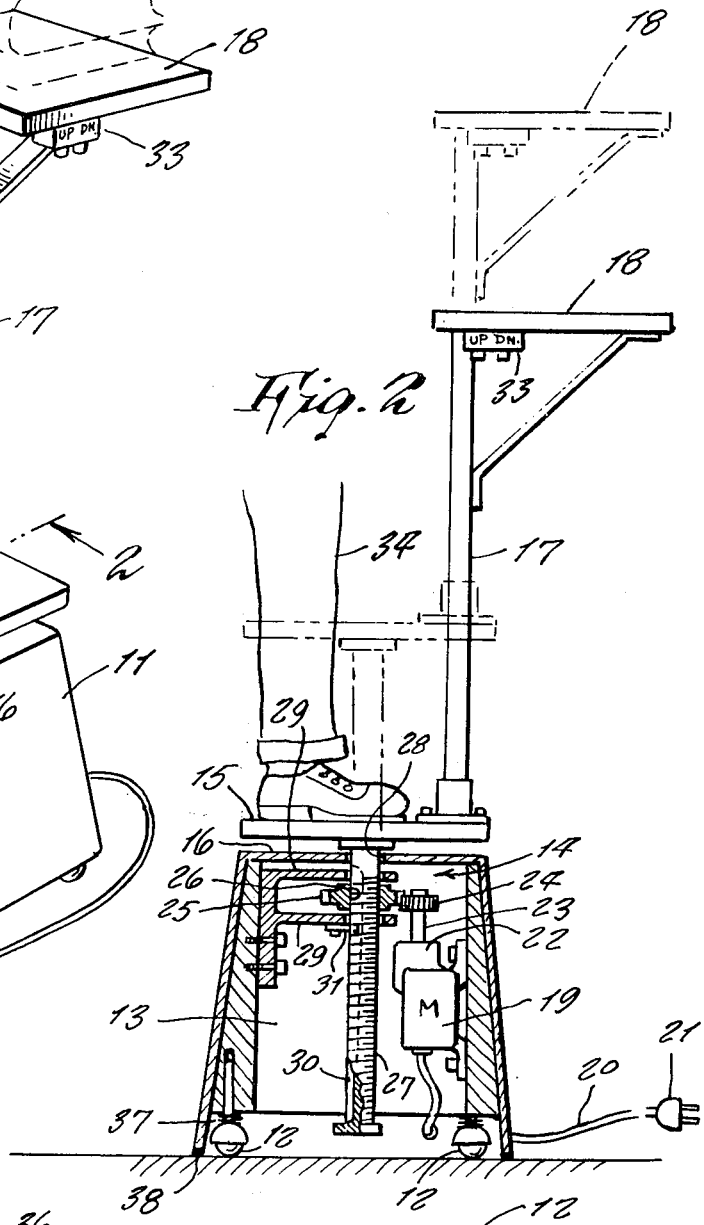
FIG. 2 is a side cross section on line 2—2 of FIG. 1.
Figure 4:
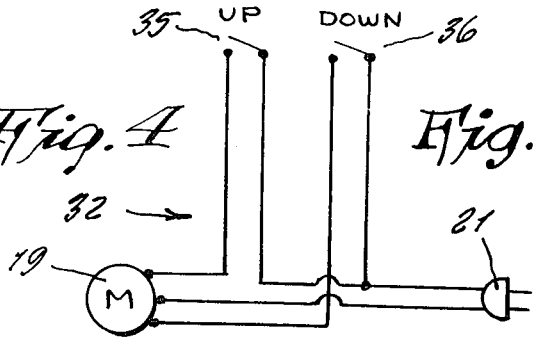
FIG. 4 is an electric circuit thereof.
Figure 3:
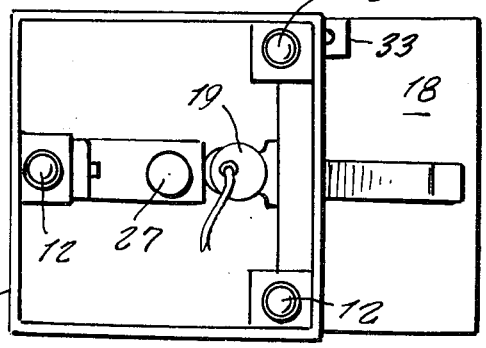
FIG. 3 is a bottom view.

The motor is in an electric circuit 32 that includes a control unit 33 mounted on the underside of the table panel so that it is convenient to be reached by a person 34 when standing upon the platform, as shown in FIG. 2. Unit 33 includes push botton operated switches 35 and 36 for running the motor either forwardly or reverse so to raise or lower the platform.

It is to be noted that the casters are downwardly urged by compression coil springs 37 so to extend lower than a rubber beaded lower edge 38 of the stool, as shown in FIG. 1, when there is no additional weight carried upon the stool so that it can travel across a floor, but wherein when additional weight is carried by the stool, such as a person, as shown in FIG. 2, the springs 37 are compressed so the stool edge 38 rests firmly on the floor surface, thus preventing it to slide or slip and endanger a person to fall off.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a stepping stool, the combination of a hollow boxlike base mounted upon three casters, a top wall of said base having an opening therethrough, a mechanism inside said base protruding upwardly through said opening and having an elevating platform secured thereupon, a post mounted on said platform, a table panel mounted on an upper end of said post, and control means for operating said mechanism to raise or lower said platform, said mechanism including an electric motor attached to an extension cord and plug, a gear reducer driven by said motor driving a gear on an output shaft of said reducer, said gear driving a second gear having a threaded central opening engaged on a vertical screw shaft, said second gear being retained against vertical travel by stationary arms above and below said second gear, a keyway along said screw shaft engaging a stationary lug whereby said screw shaft moves vertically when said second gear is rotated, said keyway extending along a longitudinal central portion of said screw shaft, opposite ends of said screw shaft forming stops for said lug traveling in said keyway, said screw shaft being shorter than a height of said base, a lower end of said screw shaft clearing a floor when said platform is at a lowest elevation, said second gear and said lug engaging said screw shaft being within an upper portion of said hollow base, compression coil springs being fitted between said casters and said base, said casters extending lower than a lower rubber edge of said base when said springs are relaxed in extended positions, said control means comprising a two switch unit mounted on said table panel, said unit being in an electric circuit with said motor and a power source.

* * * * *